US009455105B2

(12) United States Patent
Hurst et al.

(10) Patent No.: US 9,455,105 B2
(45) Date of Patent: Sep. 27, 2016

(54) CARBON NANOTUBE OR GRAPHENE BASED PRESSURE SWITCH

(75) Inventors: Adam Hurst, New York, NY (US); Lou DeRosa, Wayne, NJ (US)

(73) Assignee: Kulite Semiconductor Products, Inc., Leonia, NJ (US)

( * ) Notice: Subject to any disclaimer, the term of this patent is extended or adjusted under 35 U.S.C. 154(b) by 195 days.

(21) Appl. No.: 13/241,988

(22) Filed: Sep. 23, 2011

(65) Prior Publication Data

US 2012/0073948 A1 Mar. 29, 2012

Related U.S. Application Data

(60) Provisional application No. 61/386,603, filed on Sep. 27, 2010.

(51) Int. Cl.
*H01H 35/26* (2006.01)

(52) U.S. Cl.
CPC ..... *H01H 35/26* (2013.01); *H01H 2300/036* (2013.01); *Y10T 29/49105* (2015.01)

(58) Field of Classification Search
CPC . H01H 13/48; H01H 13/79; H01H 2215/004
USPC ..... 200/17 R, 182; 257/415–420; 73/700, 73/715, 753
See application file for complete search history.

(56) References Cited

U.S. PATENT DOCUMENTS

| | | | | |
|---|---|---|---|---|
| 3,862,387 | A * | 1/1975 | Phillips et al. | 200/83 N |
| 5,089,671 | A * | 2/1992 | Ranetkins | 200/5 A |
| 5,479,061 | A * | 12/1995 | Bobbio et al. | 310/309 |
| 5,576,251 | A * | 11/1996 | Garabedian et al. | 438/53 |
| 5,627,396 | A * | 5/1997 | James et al. | 257/415 |
| 6,498,503 | B2 * | 12/2002 | Akram et al. | 324/750.05 |
| 6,591,686 | B1 * | 7/2003 | Kurtz | 73/721 |
| 6,787,720 | B1 * | 9/2004 | Wong | 200/182 |
| 6,864,679 | B2 * | 3/2005 | Yokoji et al. | 324/207.11 |
| 7,796,317 | B2 * | 9/2010 | Iwase | 359/237 |
| 7,952,038 | B1 * | 5/2011 | Ando et al. | 200/1 B |
| 2008/0171134 | A1 * | 7/2008 | Xie et al. | 427/58 |
| 2009/0101488 | A1 * | 4/2009 | Jiang et al. | 200/512 |
| 2009/0112155 | A1 * | 4/2009 | Zhao et al. | 604/67 |
| 2010/0116630 | A1 * | 5/2010 | Pinkerton | 200/181 |

* cited by examiner

*Primary Examiner* — Renee Luebke
*Assistant Examiner* — Ahmed Saeed
(74) *Attorney, Agent, or Firm* — Troutman Sanders LLP; James E. Schutz; Christopher C. Close, Jr.

(57) ABSTRACT

The present invention describes systems and methods for providing a carbon or graphene based pressure switch. An exemplary embodiment of the present invention includes a semiconductor substrate; a cavity defined within the semiconductor substrate having a cross-sectional area and a depth; a bottom conductor disposed within the cavity; a conductive membrane disposed above the cavity and adapted to deflect towards the bottom conductor upon an applied pressure; an elastic, insulating layer disposed between the conductive membrane and the bottom conductor; and a switching element adapted to activate upon electrical communication between the conductive membrane and the bottom conductor.

20 Claims, 4 Drawing Sheets

CARBON NANOTUBE OR GRAPHENE BASED PRESSURE SWITCH

CROSS REFERENCE TO RELATED APPLICATION

This application claims the benefit of U.S. Provisional Patent Application No. 61/386,603, filed Sep. 27, 2010, the entire contents and substance of which are hereby incorporated by reference as if fully set forth below.

FIELD OF INVENTION

The present invention relates generally to pressure switches and specifically to pressure switches made using carbon nanotubes or graphene.

BACKGROUND

A pressure switch is a device that closes or opens an electrical contact when a measured pressure is above or below a certain preset pressure threshold. Pressure switches are used in a variety of different settings including manufacturing plants, automobiles, aircraft, and heavy machinery; some of these settings require the measurement of extremely high pressures. Many pressure switches utilize electromechanical devices, while others utilize a combination of piezoresistive devices or other pressure measuring sensors in conjunction with electromechanical relays. After extended use, the physical components of a pressure switch can wear down, causing the pressure switch to provide inaccurate measurements, or to fail entirely.

Accordingly, there is a need for a more durable pressure switch that can operate reliably over many more uses than a conventional pressure switch and that can be used in high pressure environments.

BRIEF SUMMARY OF THE INVENTION

The present invention describes systems and methods for providing a carbon or graphene based pressure switch. An exemplary embodiment of the present invention includes a semiconductor substrate; a cavity defined within the semiconductor substrate having a cross-sectional area and a depth; a bottom conductor disposed within the cavity; a conductive membrane disposed above the cavity and adapted to deflect towards the bottom conductor upon an applied pressure; an elastic, insulating layer disposed between the conductive membrane and the bottom conductor; and a switching element adapted to activate upon electrical communication between the conductive membrane and the bottom conductor.

An exemplary embodiment of the present invention provides a method of indicating whether a pressure exerted by a medium is above a certain threshold pressure that includes applying the pressure to a conductive membrane suspended across a cavity, wherein the pressure causes the conductive membrane to deflect toward a bottom of the cavity; and activating a load when a current flows between the conductive membrane and the cavity bottom; wherein a substantial increase in the current indicates the pressure is above the threshold pressure.

In addition, the present invention provides a method of manufacturing a pressure switch including an electrically conductive carbon-based membrane suspended across a cavity and a conductor disposed in a bottom of the cavity, the method comprising determining a depth and a geometry of the cavity to correspond to a desired threshold pressure of the pressure switch.

DETAILED DESCRIPTION

Figure 1:
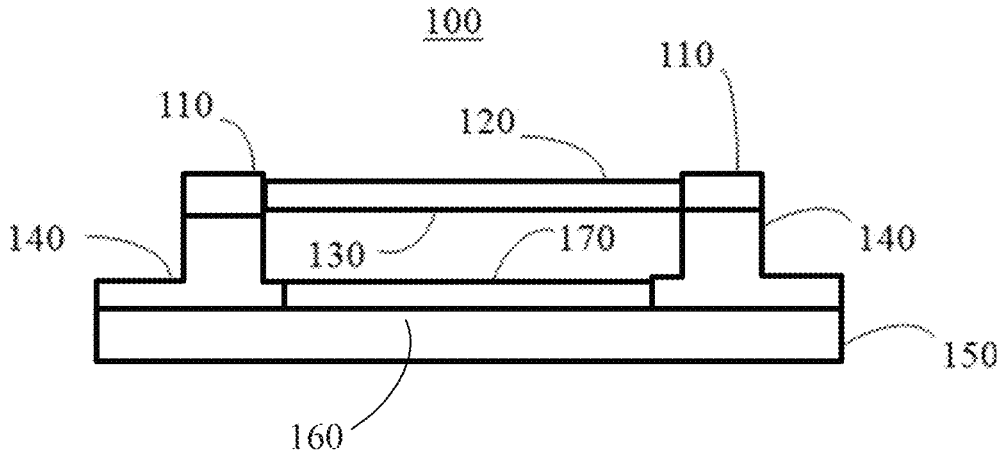
FIG. 1 provides an illustration of a block diagram of the pressure switch in accordance with an exemplary embodiment of the present invention.

To facilitate an understanding of the principles and features of the present invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples.

The elements described hereinafter as making up the invention are intended to be illustrative and not restrictive. Many suitable elements that would perform the same or similar functions as the elements described herein are intended to be embraced within the spirit and scope of the invention. Such other materials and components that are embraced but not described herein can include, without limitation, similar or analogous materials or components developed after development of the invention.

Various embodiments of the present invention are systems and methods for indicating whether the pressure exerted by a medium is above or below a certain threshold pressure. Referring now to the figures, in which like reference numerals represent like parts throughout the views, various embodiments of the pressure switch with temperature enable function will be described in detail.

FIG. 1 illustrates a block diagram of the pressure switch in accordance with an exemplary embodiment of the present invention. As shown in the exemplary embodiment of FIG. 1, the pressure switch 100 can include a carbon-based conductive membrane 120 that is suspended across a cavity in a semiconductor substrate 150. In an exemplary embodiment, the substrate 150 can be made from silicon. Electrically conductive contact pads 110 may be deposited on top of the conductive membrane 120 to secure the conductive membrane 120 in place and form electrical contact with it. The bottom of the cavity 160 can contain an electrically conductive contact pad 170 but be electrically isolated from the conductive membrane 120.

In an exemplary embodiment of the present invention, pressure can be applied to the conductive membrane 120 to cause the conductive membrane 120 to deflect toward the cavity bottom 160. As the conductive membrane 120 deflects and approaches the contact pad 170 at the cavity bottom 160, electron tunneling from the conductive membrane 120 to the bottom contact pad 170 can increase exponentially. The exponential increase in electron tunneling can enable a sharp transition from no current between the conductive membrane 120 and the contact pad 160 at the cavity bottom 160 to high current flow between the conductive membrane 120 and the contact pad 170 at the cavity bottom 160. The pressure switch 100 can turn on when the current flows between the conductive membrane 120 and the bottom contact pad 170. The pressure at which the current flows can be controlled by adjusting the geometry of the cavity. Most specifically, the depth and/or the diameter or general geometry of the cavity can be adjusted to control the pressure at which the switching from an Off state to an On state occurs.

The conductive membrane 120 can be secured in place across the cavity by the electrically conductive contact pads 110. The conductive membrane 120 can be formed from carbon nanotubes, graphene, which is a monolayer of graphite, or 1-20 layers of graphene. Both materials exhibit covalent carbon-carbon bonds with $sp^2$ hybridization that give these materials impressive mechanical properties, most notably, a high modulus of elasticity of approximately 1 TPa. Since both carbon nanotubes and graphene are defect-free crystalline structures, they are capable of withstanding extremely high strains with breakage occurring when strain exceeds approximately 25%. Being free of defects also means that they can withstand millions of cycles without weakening. Exemplary embodiments of the present invention can use these materials to form a passive pressure switch 100 that remains in an Off state until a threshold pressure is reached. Once the threshold pressure is met, the pressure switch 100 can exhibit an exponential movement to the On state, where current flows through the nanotubes or graphene into the bottom contact pad 170. In an exemplary embodiment where the conductive membrane 120 is formed from carbon nanotubes, the threshold pressure can be similarly be adjusted by varying the diameter of the cavity and diameter or overall geometry.

Figure 2:
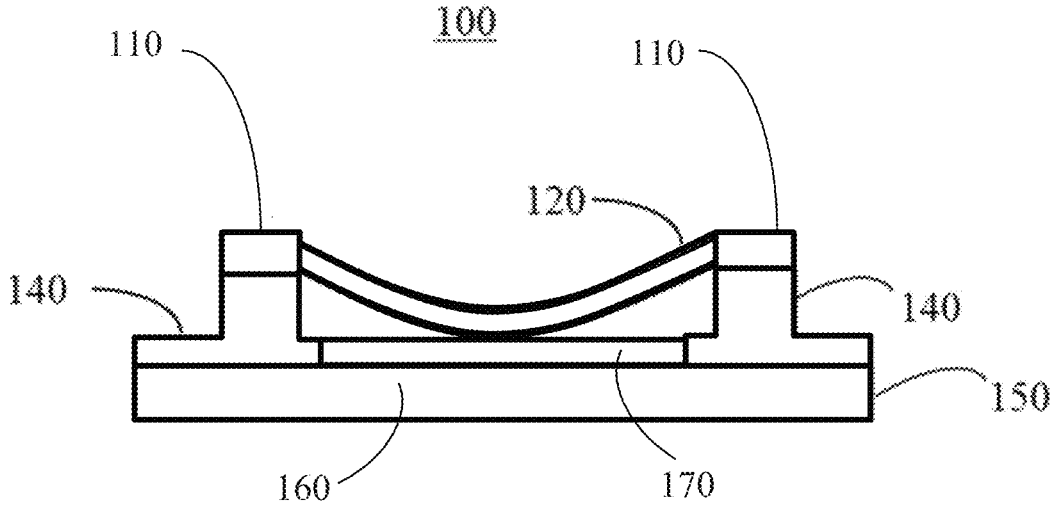
FIG. 2 provides an illustration of a block diagram of the pressure switch in accordance with an exemplary embodiment of the present invention.

FIG. 2 is an illustration of an exemplary embodiment of the present invention in which the pressure switch 100 is in the On state. It is possible that after a pressure switch 100 reaches the On state, van der Waals forces may hold the conductive membrane 120 in the deflected On position, as displayed in FIG. 2, even after the pressure is removed. This potential effect can be referred to as latch up. Latch up may be fixed by placing a thin insulating layer (not pictured), for example, parylene, between the deflected lower surface of the conductive membrane 120 and the bottom contact pad 170. The insulating layer may also latch via van der Waals forces, however by controlling the material properties and surface roughness of the insulating layer the strength of the van der Waals forces can be controlled. The insulating layer can also impart a greater elastic restoring energy to the conductive membrane 120. Further, the insulating layer can be thin enough to allow for electron tunneling, which enables a voltage to be applied to the bottom contact pad 170 to reset the device or switch it back to the Off position. The voltage may typically be negative, but will ultimately depend on the properties of the nanotubes or graphene used in the conductive membrane 120 and on the depth of the cavity. In the event the voltage is used to reset the device and the pressure applied to the conductive membrane 120 is still above the threshold pressure, the device would immediately read that it is in the On state. It shall be understood that although parylene is used in exemplary embodiments, one of skill in the art will understand that any other elastic, dielectric material can also be used.

Figure 3A:
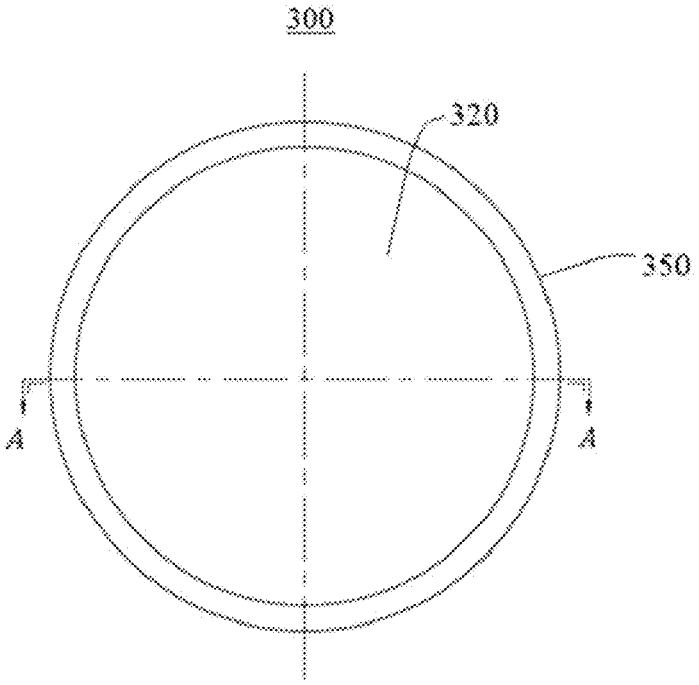
FIG. 3A provides a top view of a header configuration for a pressure switch in accordance with an exemplary embodiment of the present invention.
Figure 3B:
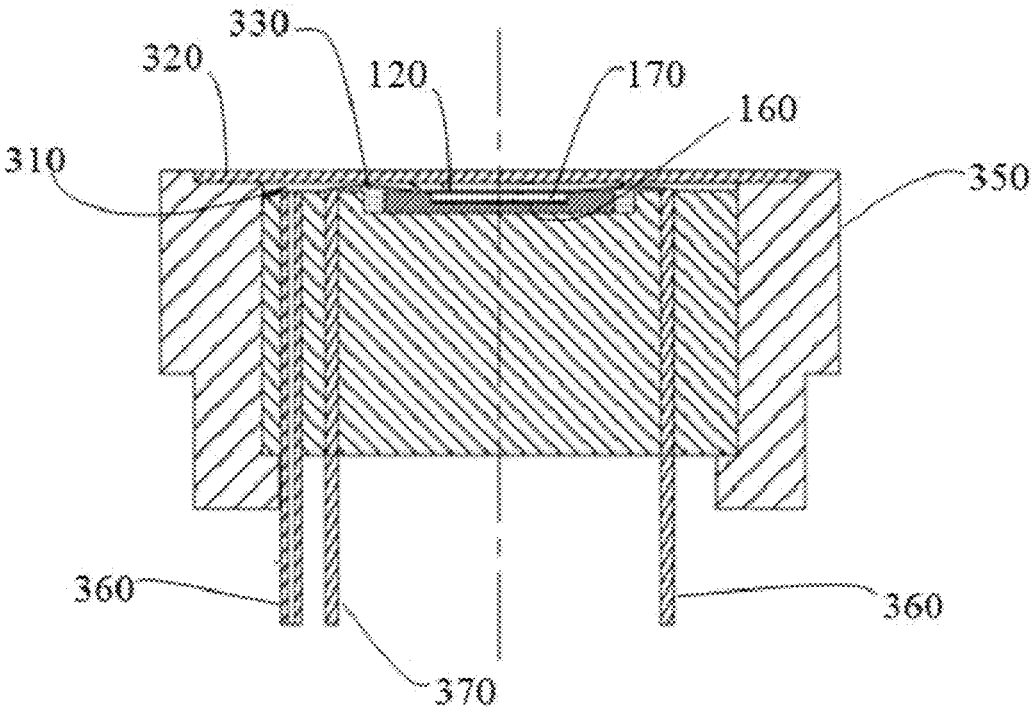
FIG. 3B provides a cross-sectional view of a header configuration for a pressure switch in accordance with an exemplary embodiment of the present invention.

FIG. 3A provides a top view of a header configuration for a pressure switch in accordance with an exemplary embodiment of the present invention. FIG. 3B provides a cross-sectional view of a header configuration for a pressure switch in accordance with an exemplary embodiment of the present invention. In an exemplary embodiment, the conductive membrane 120 may be physically separated from the medium being measured by an isolation diaphragm 320. The spacing between the isolation diaphragm 320 and the conductive membrane 120 can be filled with an incompressible liquid 310 that transfers pressure. The conductive membrane 120, whether a single sheet of graphene, or a dense array of carbon nanotubes, can be impenetrable to the relatively large molecules of the incompressible liquid 310. As pressure is applied to the isolation diaphragm 320, which can be metal or some other material, the incompressible liquid 310 transmits the pressure to the conductive membrane 120. The transmitted pressure can cause the conductive membrane 120 to deflect toward the contact pad 170 at the cavity bottom 160 in a manner similar to exemplary embodiments of the invention without the isolation diaphragm 320.

In an exemplary embodiment, a pressure switch 100 in accordance with an exemplary embodiment of the present invention can be mounted with epoxy, glass, or some adhesive material onto a header structure 350. Electrical contact can be achieved with either ball bonding (wire bonding) 330 or Kulite's leadless bonding technique. The capsule can then be filled with oil 310, or another incompressible liquid 310. The concepts of oil filling and a metal isolation diaphragm 320 employed here are presented in Kulite U.S. Pat. Nos. 6,330,829, 6,591,686 and others. The oil 310 used will be selected such that it does not penetrate the carbon nanotube fabric/array 120 or graphene film 120. The deflection (δ) of a clamped edge metal isolation diaphragm with a thickness (t) and a radius (a) deflects according to the following equation:

$$\delta = \frac{3Pa^4(m^2-1)}{16Em^2t^3}$$

E is Young's modulus of the diaphragm material, P is the pressure applied to the diaphragm, and m is the reciprocal of Poisson's ratio (Kulite U.S. Pat. No. 6,591,686).

As pressure is applied to the metal isolation diaphragm 320 it will deflect by a minimal amount, transferring the load to the incompressible oil 310, which transfers the pressure to the conductive membrane 120. The pressure causes the conductive membrane to deflect, as displayed in FIG. 2. Because the diameter of the metal isolation diaphragm is much larger than the diameter of the conductive membrane the deflection of the isolation diaphragm is very small and therefor does significantly weaken the isolation diaphragm over time. At the desired pressure, there will be an exponential increase in current between the conductive membrane 120 and the bottom contact pad 170, causing the pressure switch 100 to go from the Off state to the On state, indicating that the required pressure has been reached.

Figure 4:
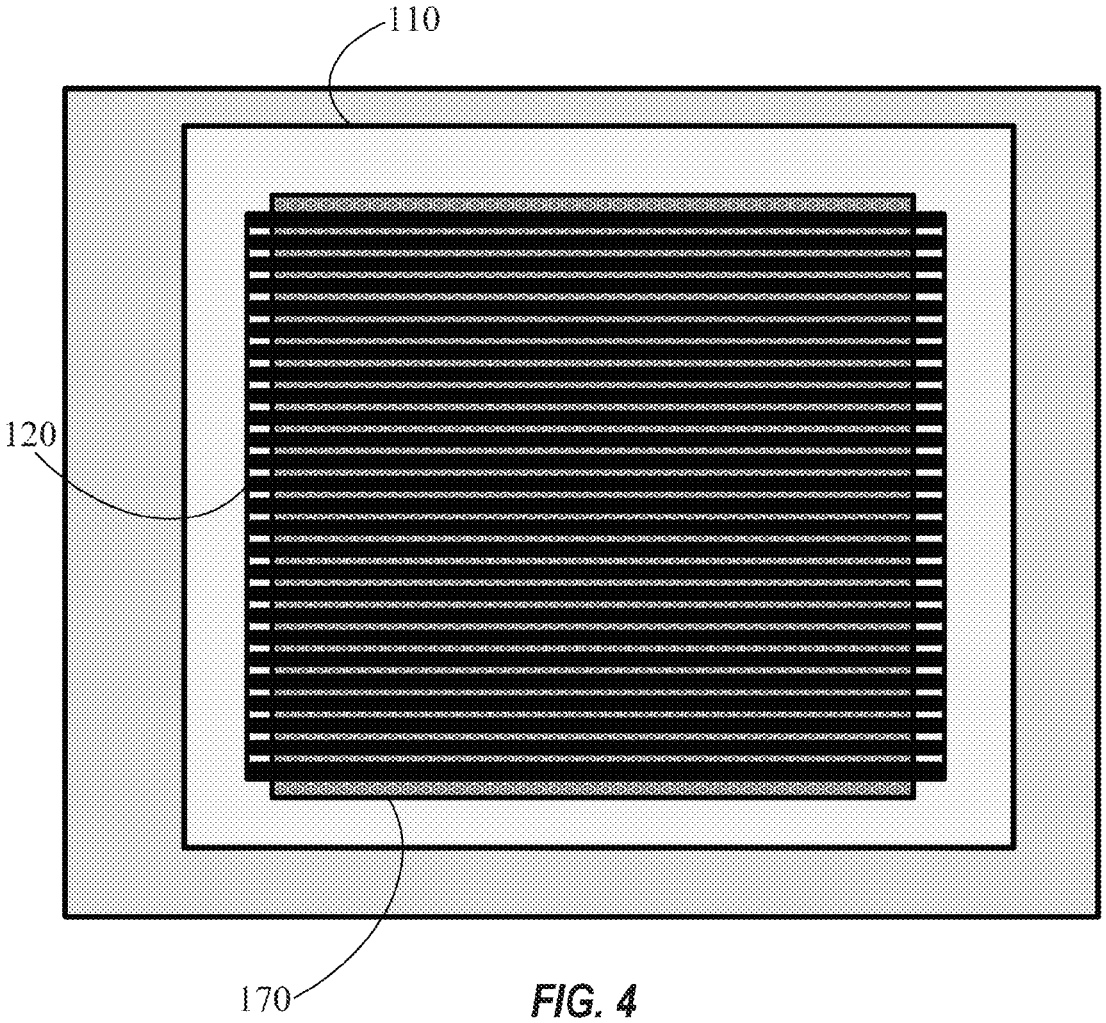
FIG. 4 provides an illustration of a conductive membrane made of carbon nanotubes grown in an array in accordance with an exemplary embodiment of the present invention.
Figure 5:
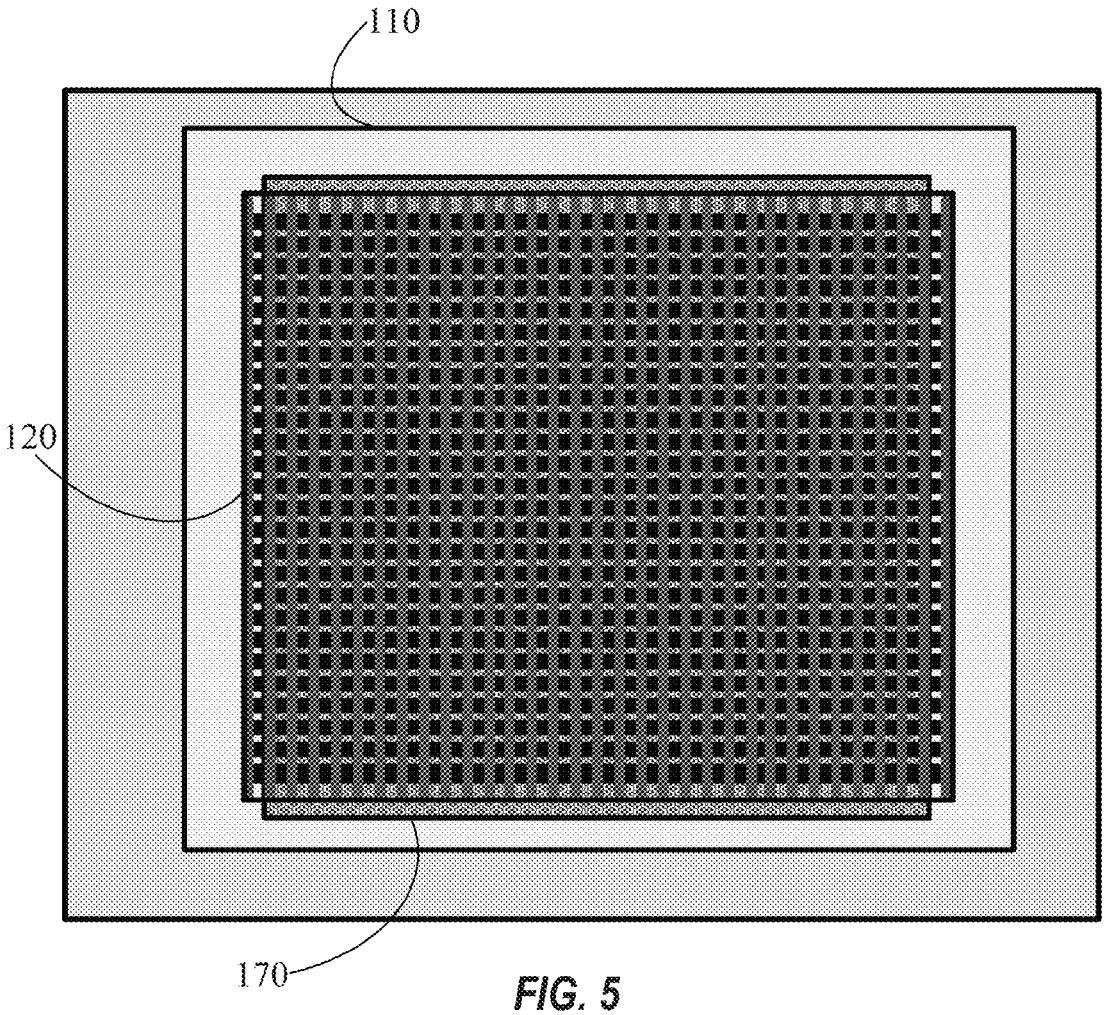
FIG. 5 provides an illustration of a conductive membrane made of carbon nanotubes grown in an unaligned fashion in accordance with an exemplary embodiment of the present invention.

In an exemplary embodiment of the present invention, the pressure switch 100 can have a micro-machined cavity. In an exemplary embodiment, the deeper the cavity, the higher the threshold pressure will be. The threshold pressure can also be affected by the overall geometry of the cavity, where the cavity can be rectangular, square, circular, or other shapes. In an exemplary embodiment, the cavity can be fabricated in silicon or some other substrate 150 using standard photolithography and micromachining techniques. Photolithography can be used to define the geometry of the cavity. A timed wet etch, such as a potassium hydroxide bath, or a dry etch method, such as reactive ion etching, can be used to define the cavity's depth. Once the cavity is fabricated, photolithography, shadow mask evaporating or some other technique can be used to deposit a layer of metal or some other conductive material 160 onto the bottom of the cavity 170. Similarly, a layer of silicon dioxide 140 or some other insulating material can be deposited or grown on the surface of the wafer 150 so that the bottom cavity 170 is electrically isolated from the conductive membrane 120 that covers the cavity. Next, the conductive membrane 120 can be grown across the cavity or transferred onto it. A conductive membrane 120 made from carbon nanotubes can be grown in an array as displayed in an exemplary embodiment of the present invention illustrated in FIG. 4. A conductive membrane 120 made from carbon nanotubes can also be grown in an unaligned fashion, creating a fabric or mesh of carbon nanotubes, as displayed in an exemplary embodiment of the present invention illustrated in FIG. 5.

In an exemplary embodiment, graphene and carbon nanotubes can be grown by a process known as chemical vapor deposition (CVD). CVD of both materials can involve a catalyst material and a carbon bearing gas. The catalyst can be deposited on the substrate 150 in the desired location of growth. The carbon bearing gas can be brought to elevated temperatures such that the gas disassociates. When flowing over the substrate 150, the free carbon atoms can attach to the catalyst and form graphene or carbon nanotubes. Carbon nanotube growth across a cavity is a common practice. In fabricating the present invention, the nanotube array can be grown across the cavity already fabricated in silicon 150. Alternatively, in an exemplary embodiment, the device can be fabricated by transferring the carbon nanotube array or graphene onto the cavity through a transfer process described below.

In an exemplary embodiment, an alternative process to achieve graphene formation is micromechanical cleavage of bulk graphite. In this process, bulk graphite can be cleaved with tape or some other material. The tape can then be stuck onto silicon dioxide or some other substrate and slowly removed. After the tape is removed, some graphene will remain secured to the surface of the substrate by van der Waals forces. The graphene can then be identified and located with an optical microscope.

In an exemplary embodiment, the cleaved graphene, CVD grown graphene, or nanotubes can be located and transferred on top of the cavity by a photoresist based transfer method. With this transfer technique, the original substrate and the graphene or carbon nanotubes can be coated with a photoresist, such as poly methyl methacrylate, then the photoresist and graphene can be lifted off of the substrate in a chemical bath. The graphene and photoresist can then be directly transferred by sliding the graphene-photoresist layer onto the new substrate.

Once the graphene or nanotubes are transferred or grown over the cavity fabricated in the silicon wafer 150, conductive contact pads 110 can be defined by photolithography, shadow mask evaporation, or some other technique and deposited by electron beam evaporation, sputtering, or thermal evaporation onto the sides of the conductive membrane 120 for electrical connection. In a separate region, the dielectric layer of silicon dioxide or some other insulting material can be removed, and metal pads can be deposited in a similar manner to form electrical connection to the bottom contact pad.

As pressure is applied to the metal isolation diaphragm 320, it will deflect, transferring the load to the incompressible oil 310, which transfers the pressure to the conductive membrane 120. The pressure causes the conductive membrane 120 to deflect. At the desired pressure, there will be an exponential increase in current between the nanotubes or graphene in the conductive membrane 120 and the bottom contact pad 170, causing the switch to go from the Off state to the On state, indicating that the required pressure has been reached.

While the invention has been disclosed in its preferred forms, it will be apparent to those skilled in the art that many modifications, additions, and deletions can be made therein without departing from the spirit and scope of the invention and its equivalents, as set forth in the following claims.

What is claimed is:

1. A pressure switch assembly, comprising:

a semiconductor substrate;

a cavity defined within the semiconductor substrate having a cross-sectional area and a depth;

a bottom conductor disposed within the bottom of the cavity, wherein the bottom conductor has a top surface;

a conductive membrane disposed above the cavity, wherein the conductive membrane has a bottom surface, and wherein the conductive membrane is configured to deflect toward the top surface of the bottom conductor upon an applied fluid pressure;

an insulating layer disposed between the bottom surface of the conductive membrane and the top surface of the bottom conductor; and a switching element, wherein the switching element is configured to activate upon sufficient deflection of the conductive membrane toward the top surface of the bottom conductor such that electron tunneling through the insulating layer produces sufficient electrical communication between the conductive membrane and the bottom conductor to activate the switching element.

2. The pressure switch assembly of claim 1, wherein the conductive membrane is made from carbon nanotubes.

3. The pressure switch assembly of claim 1, wherein the conductive membrane is made from graphene.

4. The pressure switch assembly of claim 1, further comprising an insulating layer disposed on the surface of the semiconductor substrate.

5. The pressure switch assembly of claim 4, further comprising a top conductor pad disposed on the insulating layer.

6. The pressure switch assembly of claim 1, wherein the insulating layer disposed between the bottom surface of the conductive membrane and the top surface of the bottom conductor is elastic.

7. The pressure switch assembly of claim 1, wherein the insulating layer disposed between the bottom surface of the conductive membrane and the top surface of the bottom conductor is sufficiently thin to allow electron tunneling between the conductive membrane and the bottom conductor.

8. The pressure switch assembly of claim 7, wherein the insulating layer disposed between the bottom surface of the conductive membrane and the top surface of the bottom conductor is made of parylene.

9. The pressure switch assembly of claim 1, further comprising an isolation diaphragm encapsulating the conductive membrane.

10. The pressure switch assembly of claim 9, wherein the isolation diaphragm is made of metal.

11. The pressure switch assembly of claim 9, further comprising an incompressible liquid disposed between the isolation diaphragm and the conductive membrane.

12. The pressure switch assembly of claim 11, wherein the incompressible liquid comprises molecules having sizes that are too large to penetrate the membrane.

13. The pressure switch assembly of claim 1, wherein the cavity has a shape that is substantially rectangular.

14. The pressure switch assembly of claim 1, wherein the cavity has a shape that is substantially circular.

15. A method of indicating whether a fluid pressure exerted by a medium is above a certain threshold pressure comprising:

applying the fluid pressure to a conductive membrane suspended across a cavity, wherein the cavity has a geometry and a cavity bottom having a top surface, and wherein the fluid pressure causes the conductive membrane to deflect toward the top surface of the cavity bottom;

creating an electrical potential difference between the conductive membrane and the cavity bottom; and upon the conductive membrane sufficiently deflecting toward the top surface of the cavity bottom such that sufficient current flows between the conductive membrane and the cavity bottom, activating a load, wherein a substantial increase in current sufficient to activate the load indicates the fluid pressure is above the threshold pressure.

16. The method of claim 15, wherein the substantial increase in the current is an exponential increase.

17. The method of claim 15, further comprising reversing a polarity of the electrical potential difference to counteract van der Waals' forces between the conductive membrane and the cavity bottom.

18. The method of claim 15, wherein applying the fluid pressure to a conductive membrane further comprises physically isolating the conductive membrane from the medium.

19. The method of claim 18, wherein physically isolating the conductive membrane from the medium means transferring the fluid pressure to the membrane via an isolation diaphragm and an incompressible liquid.

20. The method of claim 15, further comprising setting the threshold pressure by adjusting a distance between the conductive membrane and the cavity bottom.

* * * * *